US005352103A

United States Patent [19]

Auer

[11] Patent Number: 5,352,103

[45] Date of Patent: Oct. 4, 1994

[54] PUMP WITH UNDULATING PUMP ELEMENT

[75] Inventor: Dirk Auer, Meerbusch, Fed. Rep. of Germany

[73] Assignee: PKL Verpackungsysteme GmbH, Linnich, Fed. Rep. of Germany

[21] Appl. No.: 63,449

[22] Filed: May 18, 1993

[30] Foreign Application Priority Data

Jul. 9, 1992 [DE] Fed. Rep. of Germany ... 9290117[U]

[51] Int. Cl.[5] ..... F01C 21/04

[52] U.S. Cl. ..... 418/101; 418/104; 418/216; 418/217

[58] Field of Search ..... 418/101, 104, 216, 217, 418/228, 229, 230, 231; 277/27, 81 R, 91

[56] References Cited

U.S. PATENT DOCUMENTS

| | | | |
|---|---|---|---|
| 3,561,894 | 2/1971 | King | 418/101 |
| 4,168,936 | 9/1979 | Scheller et al. | 277/27 |
| 4,181,480 | 1/1980 | Balsinger | 418/230 |
| 4,469,017 | 9/1984 | Hanlon | 277/27 |
| 5,197,869 | 3/1993 | Hansen et al. | 418/104 |

FOREIGN PATENT DOCUMENTS

| | | | |
|---|---|---|---|
| 0362757 | 4/1990 | European Pat. Off. . | |
| 2544082 | 4/1977 | Fed. Rep. of Germany . | |
| 3418708 | 11/1984 | Fed. Rep. of Germany . | |
| 58-47196 | 3/1983 | Japan . | |
| 0313685 | 12/1989 | Japan | 418/104 |
| 8908782 | 9/1989 | PCT Int'l Appl. . | |

*Primary Examiner*—Richard A. Bertsch
*Assistant Examiner*—Charles G. Freay
*Attorney, Agent, or Firm*—Meltzer, Lippe, Goldstein, Wolf, Schlissel & Sazer

[57] ABSTRACT

A pump comprises a pump casing having a pump channel, a pump element rotating in the pump channel, and a rotor shaft mounted in the pump casing and attached to the pump element. The pump element has a cylindrical outer periphery, and undulating surfaces in the axial direction. The opening in the casing which receives the rotor shaft has an annular groove in which there is disposed a spring loaded sealing element which bears slidably against a flat end face of the pump element when the pump element rotates. The sealing element is subjected to the pressure of superheated steam which is conducted to the sealing element via pressure channels in the pump casing connected to the annular groove. The rotor shaft includes radial and axial channels through which a coolant flows.

6 Claims, 2 Drawing Sheets

PUMP WITH UNDULATING PUMP ELEMENT

BACKGROUND OF THE INVENTION

The invention relates to a pump having a pump element which is shaped undulating in the axial direction and cylindrical at its periphery and which is attached to a rotor shaft mounted in a pump casing and rotates in a pump channel of the pump casing.

A pump of the kind specified is known from German OS DE 34 18 708 A1. That pump has a rotor which is disposed in a pump channel and which is formed with the pump element projecting cantilevered. The pump element is formed undulating in its axial longitudinal direction, while its peripheral surfaces are constructed cylindrical. The rotor is attached to a rotor shaft connected to a drive and rotates in a pump channel formed in the pump casing and connected to a pump inlet and a pump outlet. To provide a sealing between the pump inlet and outlet, provided in the pump channel are axially displaceable sealing elements which are forced against the working surface of the pump element and follow the undulatory movement of said element as it rotates.

This prior art pump has been proved to have a reliable delivery, more particularly when delivering thick substances. However, problems arise if the pump is to be used in aseptic surroundings. In such a use it has been found that with this prior art pump, particles entering the pump from outside may cause contaminations of the substance delivered in the pump channel. Moreover, due to the construction of conventional seals, residual deposits of the material conveyed accumulate and may also cause contamination of the material delivered. This is more particularly the case if, due to the running clearance required by the construction, the rotor and shaft bearing system causes excessive stressing of the seal and finally leads to its destruction.

It is an object of the invention so to improve a pump of the kind specified as to make it impossible for particles entering the pump casing from outside to contaminate the material delivered in the pump channel to the pump, while at the same time preventing the depositing of said material. This problem is solved according to the invention by the features that starting from the wall of the pump casing adjacent the rear end face of the pump element, the wall of the casing opening receiving the rotor shaft is formed with an annular groove in which there is disposed a spring-loaded sealing element which bears slidably against the flat end face of the pump element when the pump element rotates and which is subjected to the pressure of superheated steam via pressure channels connected to the annular groove, the rotor shaft having radial and axial channels which form a cooling system and through which a coolant flows.

The provision according to the invention of a seal which is forced as a slide ring seal against the flat end face of the pump element when the pump element rotates ensures a reliable seal of the inner space of the pump casing against atmosphere. Since moreover superheated steam is used to press the seal in contact against the end face of the pump element, sterility is ensured, even if the sealing leaks. Moreover, the side ring elements are stressed concentrically flat-running and are disposed in the flushed inner zone of the pump. This arrangement enables the interior of the pump with the slide ring elements to be cleaned in a simple manner. In this way, when the pump is used in aseptic conditions, it is impossible for the pumped material to be contaminated with impurities at any time.

At the same time the cooling system, which is formed by channels extending radially and axially in the rotor shaft and through which coolant flows, ensures that the pump cannot be damaged by overheating. The invention therefore enables sterile superheated steam to be used for the contact pressure of the seal, while at the same time ensuring the smooth, reliable operation of the pump.

Wear on the sealing element can be reduced by the feature that the flat end face of the pump element is formed with a recess in which a slide ring is disposed against which the sealing element disposed in the annular groove of the casing opening bears. In this way the material of the seal and the material of the slide ring can be adapted to one another in an optimum manner, thus ensuring satisfactory sliding behaviour with low wear on the seal.

More particularly with a one-sided bearing system for the rotor shaft, the rotor shaft is mounted in a bearing flange at least one of whose end faces has cooling fins. With the use of such bearing flange, the heat generated by the sterile barrier subjected to pressure loading with superheated steam during pump operation is removed.

Conveniently the cooling fins extend vertically, since in that case use can be made of the natural air flow set up by the convection of the heated surrounding air. Such cooling can also be used simultaneously for cooling the pump casing if the cooling fins extend on the end face of the bearing flange associated with the pump casing. In addition, the cooling effect of the cooling fins can be boosted by the feature that the coolant flowing through the rotor shaft flows around the cooling fins.

BRIEF DESCRIPTION OF THE DRAWINGS

The invention will now be explained with reference to an embodiment thereof shown in the drawings. FIG. 1 is a plan view, partially opened-up, of a partial section of a pump according to the invention used in aseptic surroundings, while

DETAILED DESCRIPTION OF THE INVENTION

Figure 1:
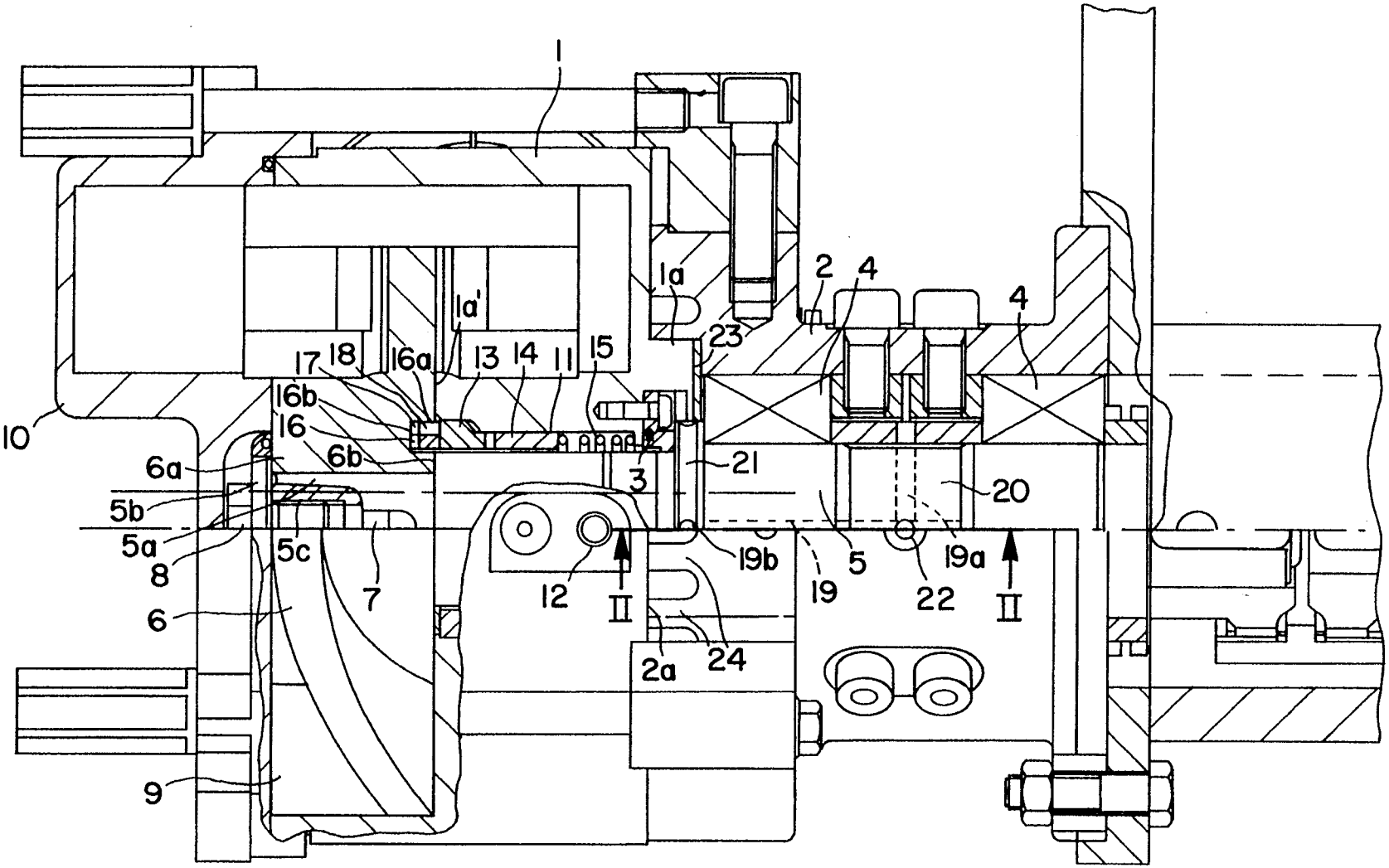
Figure 2:
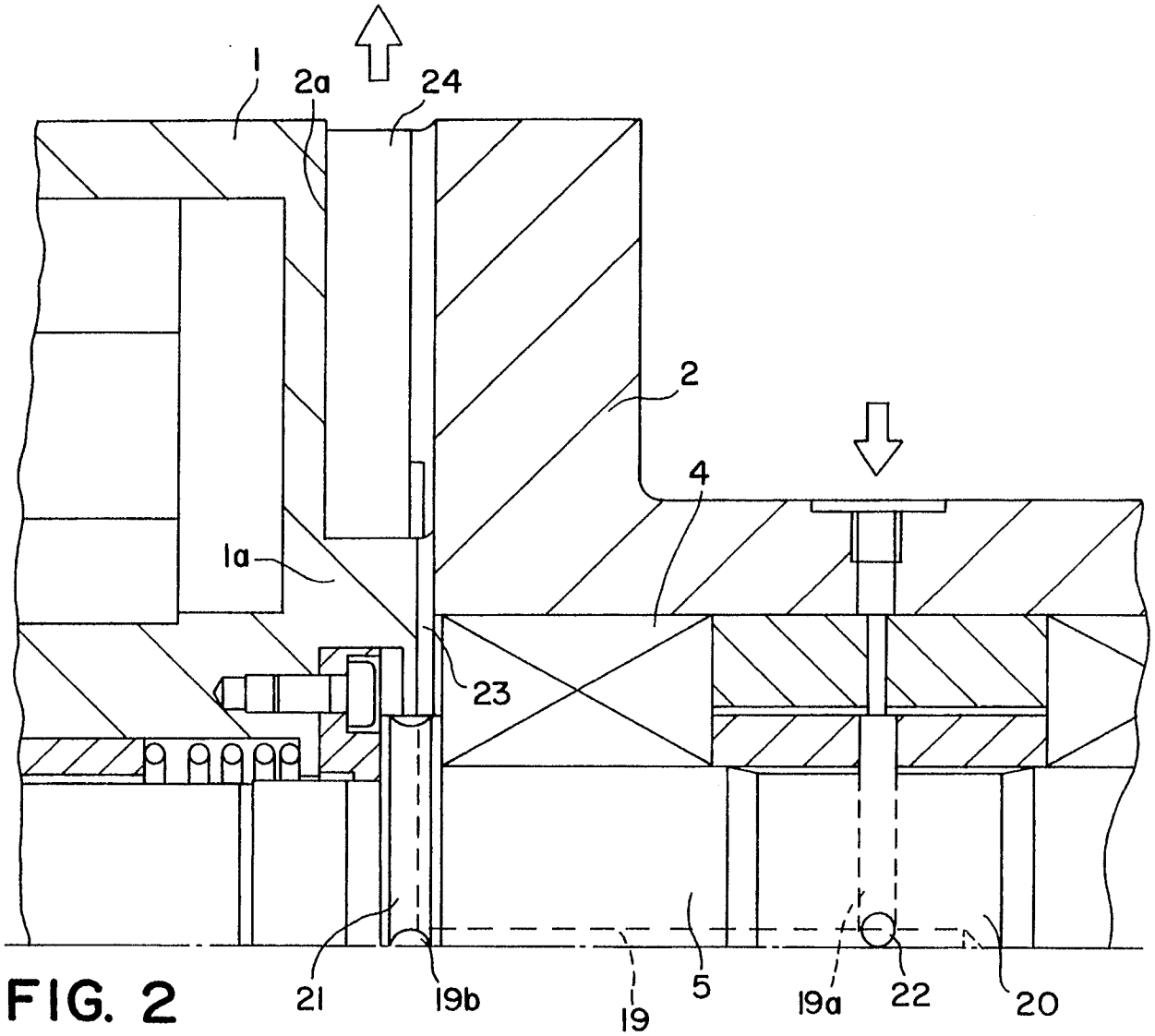
FIG. 2 is a cross-sectional view taken along line II—II of FIG. 1.

A pump has a pump casing 1 which is attached to a bearing flange 2. The rear casing wall 1*a* associated with the bearing flange 2 is formed coaxially with the opening of the bearing flange 2 with a casing opening 3 through which a rotor shaft 5 mounted on one side by bearings 4 in the bearing flange 2 extends into the pump casing 1.

A pump element 6 constructed undulating in the axial longitudinal direction of the pump and cylindrical at its periphery is connected via its hub 6*a* non-rotatably to the rotor shaft 5 at a shaft chamfer 5*a* at the front end 5*b* of the rotor shaft 5 by means of a feather 7 and a screw 8 screwed into an end face bore 5*c* of the rotor shaft. The pump element 6 rotates in a pump channel 9 enclosed by the pump casing 1, the front end wall of the pump channel 9 being formed by a removable casing cover 10.

Starting from the inside 1*a'* of the rear casing wall 1*a*, the casing opening 3 is formed with a radially extending annular groove 11 connected via a channel (not shown) to a superheated steam inlet 12. Bearing against the front end of the annular groove 11 is an annular sealing element 13 loaded via an annular pressure member 14 by the force of a spiral spring 15 clamped between the pressure member 14 and the rear shoulder of the annular groove 11.

The flat rear end wall 6*b* of the hub 6*a* of the pump element 6 adjacent the casing opening 3 is formed with a second annular-groove-shaped recess 16 in which a sealing ring 17 is disposed which has a rectangular cross-section. The arms of the sealing ring 17 seal a slide ring 18 in relation to the outer wall 16*a* and the end wall 16*b* of the recess 16. The slide ring 18 bears via its end face against the sealing element 13.

When acted upon with the pressure of superheated steam, the sealing element 13 is forced against the slide ring 18 which, when the pump element 6 rotates, slides on the sealing element 13, the sealing effect of the annular seal 17 also being boosted at the same time by the contact pressure. This ensures a durable sealing of the pump channel 9 in relation to the superheated steam in the annular groove 11, while at the same time ensuring adequate contact pressure.

For the cooling of the rotor shaft 5, which is heated by the super hot steam present in the annular groove 11, the rotor shaft 5 is formed with an axial bore 19 connected to radial channels 19*a, b* of the rotor shaft 5 to form a system of cooling lines. The radial passages 19*a, b* discharge into annular grooves 20, 21 let into the outside of the rotor shaft 5. The first annular groove 20 cooperates with the inside wall of the opening of the bearing flange 2 to form a chamber via which compressed air, which enters the chamber via a compressed air connection 22, is fed into the cooling line system of the rotor shaft 5.

The compressed air emerges from the rotor shaft 5 via the radial channels 19*b* and is led away via a gap 23 formed between the adjacent end walls 1*a*, 2*a* of the pump casing 1 and the bearing flange 2. Cooling fins 24 aligned in the vertical direction and formed on the end wall 2*a* of the bearing flange 2 associated with the pump casing 1 are thereby flowed around, the inflow and outflow of the compressed air being shown by the arrows in FIG. 1. In this way the cooling air cools not only the rotor shaft 5 itself, but the pump casing 1 and the bearing flange 2 also.

I claim:

1. A pump having a pump element (6) which is shaped undulating in an axial direction and cylindrical along a periphery of the pump element (6) and which is attached to a rotor shaft (5) mounted in a pump casing (1) and rotates in a pump channel (9) of the pump casing (1), characterized in that starting from a wall (1*a*) of the pump casing (1) adjacent a rear end face (6*b*) of the pump element (6), a wall of a casing opening (3) receiving the rotor shaft (5) is formed with an annular groove (11) in which there is disposed a spring-loaded sealing element (13) which bears slidably against said rear end face (6*b*) of the pump element (6) when the pump element (6) rotates said sealing element being subjected to the pressure of superheated steam via pressure channels connected to the annular groove (11), the rotor shaft (5) having radial and axial channels (19*a, b*) which form a cooling system and through which a coolant flows.

2. A pump according to claim 1, characterized in that the flat end face (6*b*) of the pump element (6) is formed with a recess (16) in which a slide ring (18) is disposed against which the sealing element (13) disposed in the annular groove (11) of a casing opening (4) bears.

3. A pump according to claim 1, characterized in that the rotor shaft (5) is mounted in a bearing flange having end faces (2) at least one of said bearing flange end faces (2*a*) has cooling fins (24).

4. A pump according to claim 3, characterized in that the cooling fins (24) extend vertically.

5. A pump according to claim 3, characterized in that the cooling fins extend on an end face (2*a*) of the bearing flange (2) associated with the pump casing (1).

6. A pump according to claim 3 characterized in that the coolant flowing through the rotor shaft (5) flows around the cooling fins (24).

* * * * *